United States Patent [19]

Koula

[11] 4,244,999

[45] Jan. 13, 1981

[54] METHOD OF MANUFACTURING A CUT TEXTILE PIECE POSSESSING VARIABLE STIFFNESS OVER ITS SURFACE

[75] Inventor: Zdenek Koula, Regensdorf, Switzerland

[73] Assignee: Stotz & Co., Zürich, Switzerland

[21] Appl. No.: 765,454

[22] Filed: Feb. 3, 1977

[30] Foreign Application Priority Data

Feb. 19, 1976 [CH] Switzerland ..... 2056/76

[51] Int. Cl.[3] ..... B32B 3/00; B32B 27/14

[52] U.S. Cl. ..... 428/196; 2/143; 2/255; 83/901; 101/129; 223/4; 427/208.2; 427/210; 427/289; 427/372.2; 428/245

[58] Field of Search ..... 427/210, 288, 324, 208.2, 427/372.2, 289; 2/143, 255; 83/901; 223/4; 428/245

[56] References Cited

U.S. PATENT DOCUMENTS 3,333,280 1/1967 Hynek et al. ..... 2/143

3,914,493 10/1975 Gräber et al. ..... 428/200 X

*Primary Examiner*—Bernard D. Pianalto

*Attorney, Agent, or Firm*—Werner W. Kleeman

[57] ABSTRACT

A method of manufacturing a flat cut textile piece possessing variable stiffness over its surface, which comprises fabricating cut textile pieces from a dimensionally stable web-like flat structure. There is applied to the cut textile pieces, in accordance with a predetermined pattern and in a predetermined quantity, a preparation containing at least one substance forming a film at the prevailing processing temperature. This film possesses a Shore hardness A of at least 50 at a temperature of about 20° C. and at a temperature of about 100° C. possesses at most 80 percent of the hardness value measured at 20° C. This film does not melt at a temperature below about 180° C. Then the cut pieces are dried. The flat cut textile pieces produced according to the invention are preferably used as inserts for various clothes or garments, such as collars and cuffs.

21 Claims, No Drawings

METHOD OF MANUFACTURING A CUT TEXTILE PIECE POSSESSING VARIABLE STIFFNESS OVER ITS SURFACE

BACKGROUND OF THE INVENTION

The present invention relates to a new and improved method of manufacturing a substantially flat cut textile piece or blank possessing variable stiffness or reinforcement over its surface, and also pertains to cut textile pieces produced according to the aforesaid method and the use thereof as inserts for various articles of clothing or garments.

Numerous attempts have been heretofore made to impart to flat textile structures different degrees of stiffness or reinforcement over their surface. These flat textile structures are especially useful as reinforcement inserts for the most various types of clothing or garments.

In Swiss Pat. No. 208,340 there is disclosed a method of reinforcing articles formed of pliable or flexible fabrics, wherein a colorless liquid reinforcement agent is applied to the semi-finished or finished article. The reinforcement agent, following evaporation of the solvent thereof, does not exert any bonding action upon neighboring fabric layers. Application of such reinforcement agent is accomplished in such a manner that there is realized a stepped degree of stiffness, i.e. a varying stiffness or pliability of the article which is accommodated to the conditions of use. This variable stiffness is produced by covering individual regions of the fabric during application of the reinforcement agent, by employing different concentrations of the solution to be applied, or by varying the applied quantity by means of the spraying device or other applicator.

SUMMARY OF THE INVENTION

It is a primary object of the present invention to provide a new and improved method of imparting a variable degree of stiffness across the surface of a cut textile piece or blank.

Another and more specific object of the present invention aims at manufacturing a cut textile piece having a variable degree of stiffness across its surface which is effectively controlled in accordance with the contemplated use of such cut textile piece or the like.

Yet a further object of the present invention aims at improved constructions of cut textile pieces or blanks having controlled variable stiffness across the surface thereof, and particularly suitable for use as reinforcement inserts for sundry clothing items or garments, especially collars and cuffs.

Now in order to implement these and still further objects of the invention, which will become more readily apparent as the description proceeds, the method of the present invention for manufacturing a flat cut textile piece or article having a variable degree of stiffness or reinforcement over its surface is manifested by the features that dimensional stability is imparted to a substantially web-like flat textile structure, and cut textile pieces or blanks are cut-out therefrom. Then, a preparation is applied to the cut textile pieces in accordance with a desired or predetermined pattern and in a predetermined quantity. This preparation contains at least one substance which forms a film at least during the processing temperature. This film has a Shore hardness A of at least 50 at a temperature of 20° C., preferably a hardness in the range of 80 to 100, and at a temperature of 100° C. has a Shore hardness A amounting at most to 80 percent of the value measured at 20° C., and below 180° C. such film does not melt. Then, the thus processed cut textile pieces or blanks are dried.

DETAILED DESCRIPTION OF THE PREFERRED EMBODIMENTS

Considering now the invention in greater detail, it is here firstly mentioned that suitable for use as the flat textile material for the practice of the invention are fabrics, knitted fabrics, fleeces or webs, by way of example, formed of natural and/or synthetic fibers, especially from cellulose, polyester and polyamide.

The invention contemplates imparting dimensional stability to the web-like flat textile structure prior to cutting. This can be accomplished by conventional techniques when working with structures formed of synthetic fibers by thermofixing and when working with those formed of cellulose fibers by cross-linking. Suitable cross-linking agents are thermally settable reaction-type plastic resins in the form of their precondensates or components fabricated from nitrogen compounds with amide-like bound nitrogen (—CO—NH) and monofunctional or polyfunctional carbonyl compounds, especially aldehydes, for instance reaction products of formaldehyde, glyoxal, acrolein with urea or homologues thereof, especially cyclic aklylene urea material, ureines, so-called triazones or other heterocycles with the grouping —NH—CO—NH. Further examples are monomeric or polymeric cross-linking agents possessing aldehyde groups, especially low-molecular aldehydes (formaldehyde, glyoxal, acrolein, acetaldehyde, as such or in the form of derivatives such as acetales, enolic ethers, polymers or other reaction products which, at the employed reaction conditions, are capable of cross-linking cellulose or splitting-off the cross-linking acting aldehydes) di- or polyfunctional cross-linking agents, containing epoxide-, isocyanate-, vinylsulfo- or other vinyl- or acrylic groups capable of undergoing reaction, vinylsulfo compounds, for instance divinylsulfon, divinylsulfoxide, organic halogen compounds which act in a cross-linking manner, halohydrin, dicarboxylic acids in a free state or in the form of derivatives, di- or polyfunctional "onium" compounds (sulfonium, phosphomium and so forth) for reaction products of two carbonyl compounds capable of cross-linking cellulose, such as for instance ketones with low-molecular aldehydes, especially formaldehyde, acrolein, glyoxal. All of the previously mentioned compounds are advantageously brought to reaction in known manner by means of suitable catalysts (acidic, basic, potentially acidic or basic substances, radicals, radiation) and, if desired, together with agents having a swelling effect upon the fiber material and/or conventional products which mutually influence the friction of the fiber- or yarn components.

There also can be employed cross-linking which, by means of graft polymerization reactions at the hydroxyl groups of the cellulose, produce the inclusion or production of high polymers in situ. Generally, there can be used such agents which bring about an increase in the intramolecular cohesion of the cellulose. There is advantageously employed a catalyst which catalyzes the bonding or formation of bridges, whether such be by acid or alkaline reactions or through splitting-off of radicals. Good results have been obtained with acidic catalyzation when using metal salt catalysts, for instance zinc- or magnesium salts, such as zinc chloride, zinc nitrate, magnesium chloride or magnesium nitrate, especially those which in aqueous solutions exert a swelling action upon the cellulose corresponding to a yarn untwisting index of at least 1 in 0.1 molar solution, as determined according to the procedures described in Textile Research Journal 32 (1962), page 1041.

The flat textile structure can be provided according to known techniques with the cross-linkable substance. Additionally, the sizing bath can have added thereto plasticizers, white or colored pigments or pigments which form dyes, surface-active elements, brighteners, hydrophobic agents and texture improving-sizing agents. In this regard there may be employed solutions, emulsions or dispersions or also foam-like sizing baths and there also can be used multi-phase systems which contain solvents of different boiling point and/or different solubility for individual ones or a number of the components contained in the bath.

If desired, the cross-linking agent and/or the catalyst can be applied in gaseous state to the textile material. The application thereof and the cross-linking, if desired, also can take place in a number of stages wherein, if necessary, different cross-linking agents and catalysts, different cross-linking conditions (especially a different degree of swelling of the cellulose) can be used during cross-linking, and the change in the molar relationship of the reaction components can take place during one or a number of the cross-linking stages.

Due to the dimensional stabilization treatment to which the textile material is subjected, it is possible to simultaneously reduce the swellability of the cellulose fibers. The same purpose can be served by treating the textile material with a water repellent or hydrophobic agent containing an organic silicon compound or a wax. Due to the reduction of the swellability there is obtained the result that the preparation producing the stiffening action only remains adhering to the surface of the flat textile structure and does not penetrate through the latter.

The production of the cut textile pieces or cut blanks from the dimensionally stable flat textile structure can be carried out according to known techniques, for instance by cutting, punching or stamping with conventional tools, a laser beam or a water jet. It is thereby possible to work with single- or plural layers, i.e. there can be cut one or a number of layers of the flat textile structure at the same time.

The preparation used with the invention and which is to be applied to the cut pieces can be employed in the form of a solution or preferably as a dispersion, there being used dispersions which following coagulation do not again disperse. Particularly suitable are pastes containing water and/or solvents.

The preparations contain at least one substance which forms a film at the employed processing temperature. At 20° C. this film has a Shore hardness A of at least 50, preferably between 80 to 100, and at a temperature of 100° C. the Shore hardness A at most amounts to 80 percent, preferably at most 75 percent, of the value measured at 20° C., and below 180° C., preferably 200° C., it does not melt. This constitutes a significant feature of the invention and means that in practice cut textile pieces or blanks treated with such substances during their use (at room temperature) possess the desired stiffness, but in the presence of temperatures encountered during conventional textile handling or care treatment reversibly soften, and the mechanical wear, for instance during washing or cleaning and upon drying in a drying drum, is considerably reduced.

As the processing temperature there is intended that temperature at which there is carried out the further processing of the cut textile pieces or blanks produced according to the invention, and for instance in the case of inserts for garments or the like such amounts to the pressing or ironing temperature employed during ready-made clothing manufacture. This temperature always is above 100° C., as a rule between 120° C. and 200° C. Under the designation film-forming substances there is to be understood such materials which, after application to a glass plate in a liquid state, after evaporation thereof, if necessary after heating to the processing temperature, form a coherent coating.

As the film-forming substances there basically come into consideration all macro-molecular materials which form films and whose films possess the above-mentioned hardness values. Preferably there are used acrylates, vinyl compounds, especially if desired cross-linked polyvinylacetate, pre-polymerized chlorine containing monomers as well as copolymers of the above components.

The preparation containing the film-forming substance can have added thereto additional adjuvants or additives usually employed in the textile industry, such as surface-active agents, anti-foaming agents, dies, pigments, optical brighteners, thickening agents, moisture retaining agents, biocides, preservatives, aromatic substances and/or substances for marking. Thickening of the preparations also can be accomplished by producing a foam. After its application this foam can decompose, be destroyed or affixed by drying.

The preparation can also contain one or a number of cross-linkable components. This component can simultaneously constitute the substance or substances forming the film. The cross-linking of such component can be accomplished by utilizing conventional techniques during drying or can be carried out in a continuous or separate step following drying. In this case there is to be understood under the term "cross-linking" the transformation of a macro-molecular substance from the soluble into the insoluble state, and there must not be formed any duroplast or thermosetting plastic. Cross-linking takes place within the cross-linkable substance, not however with the substrate, i.e. the cut textile piece or blank.

The above preparation is applied in a desired or predetermined pattern and in a desired or predetermined quantity to the cut textile pieces or blanks. The cut textile pieces can be present in the form of single- or multi-layer structures. Application can be accomplished according to all methods suitable for this purpose, for instance by spraying, scraping-on, imprinting according to the screen printing or transfer printing techniques or application of microcapsules, upon the destruction thereof there being released the preparation. During spraying the patterns can be produced by programming the nozzles and/or by covering the surfaces which are not to be treated. Different quantities and thus different degrees of stiffening can be realized by controlling the applicator device, by utilizing different concentrations of the preparation, and by employing different numbers of application cycles.

As the printing techniques that can be used all of the heretofore known printing methods, such as high pressure or relief printing , photogravure printing or screen printing, the latter being preferred. During relief printing there can be employed, for instance, punches formed of an absorbent material at those locations which are effective during the printing operation. The templates for the silk screen printing can be produced according to the so-called resist-, undercoating or preferably photo techniques and depending upon the operating conditions can be spanned with Müller gauze, a synthetic fabric or metallic filter or sieve, especially formed of bronze. As the squeegee there can be used wood-, rubber- or roll squeegees. The advancing movement of the cut pieces past the printing device can be carried out by means of an endless conveyor band, for instance formed of rubber, by means of grippers, suction elements or needle rolls.

The printing operation can take place in one or a number of steps. If there is required a considerable stiffening effect at a predetermined location, then, the cut piece can have imprinted thereon a number of times the same preparation or different preparations in succession. The quantity of the imprinted preparation having a reinforcing effect can be varied by means of its viscosity and with the screen printing technique also by the hardness, shape, printing pressure, contact angle and speed of the squeegee as well as by means of the thickness of the sieve.

The preparation can be applied at one or both faces to the cut textile piece or blank. When applying such to one face then the non-treated surface is provided with a heat-sealable coating, preferably prior to the application of the preparation.

The pattern and the quantity of the applied preparation is determined in accordance with the desired use properties of the cut textile piece or blank. Thus, when employing such as collar inserts the fold-over line and the seam edge can remain non-stiffened and the collar tips strengthened and stiffened, if desired by means of an applied quantity which is greater than that at the remaining surface. Similar considerations of course are valid for other fields of use.

The cut textile pieces produced according to the invention possess, in contrast to those obtained according to the teachings of Swiss Pat. No. 208,340, above all an increased resistance for all handling treatments which are conventional for textile materials. This advantage is brought about, on the one hand, due to the dimensional stabilization and, on the other hand, due to the changed hardness of the film-forming substance at elevated temperature. Of course, this durability or resistance is not only present for the cut textile pieces, but also for the garments which have incorporated therein or contain such cut textile pieces.

Furthermore, due to the application of the preparation at one face of the textile material there is afforded the possibility of applying to the other face or surface a heat-sealable coating and to appropriately form the pattern of the adhesive bond during heat sealing independent of the pattern and the degree of reinforcement or stiffening.

The cut textile pieces or blanks produced according to the invention are particularly suitable for manufacturing reinforcement or stiffening inserts for garments or clothing items, such as collars, cuffs, pocket flaps, the front portions of jackets and other garments and other portions or trimmings of top clothing, for instance blouses, shirts, coats, lounge jackets and women's suits, just to mention some other possibilities.

Depending upon the selection of the employed preparation there can be obtained a stiffness or reinforcement which is resistant to washing and/or chemical cleaning. As the collar inserts there are preferred cut textile pieces exhibiting as small as possible reduction of the stiffness when exposed to a boiling wash.

Having now the benefit of the foregoing discussion of the invention the same will be further considered in conjunction with the following examples. The indicated stiffness values have been measured in accordance with British Standard No. 3356/1961.

EXAMPLE 1

Dimensional-Stability Finish

With the following preparations cellulose fabrics were impregnated upon a padding machine, and the squeezing effect amounted to 80 percent:

| | | |
|---|---|---|
| (a) | Dimethyl ethylene urea (50% by weight) | 45 g |
| | $MgCl_2 . 6H_2O$ | 5 g |
| | "SAPAMIN AL" (plasticizer formed on the basis of a quaternary ammonium compound) | 25 g |
| (b) | Dimethyldihydroxy ethylene urea (50% by weight) | 60 g |
| | $Zn(NO_3)_2$ | 8 g |
| | "AVIVAN" (fatty acid condensation product) | 30 g |
| (c) | Dimethylpropylene urea (50% by weight) | 75 g |
| | $MgCl_2 . 6H_2O$ | 8 g |
| | Polyethylene dispersion | 35 g |

The impregnated fabric is dried and condensated for three minutes at 150° C.

EXAMPLE 2

A preparation consisting of:

| | |
|---|---|
| "SOLVITOSE HDF" (a strong ether) (20% by weiight) | 430 g |
| "CULMINAL C 1525 K5000" (methyl cellulose thickener) (2% by weight) | 340 g |
| "ELOTEX AGUADUR" (polyvinylacetate) | 140 g |
| "ANTIMOUSSE H" (silicon defoaming agent) | 20 g, |

which is present in the form of an aqueous paste without the further addition of water, is applied by means of a screen printing process to a cut textile piece or blank formed of cotton fabric, which has been subjected according to Example 1 to a dimensional-stabilization treatment, in a desired pattern. The cut textile piece has the shape of a collar insert and a surface area of about 300 $cm^2$. At the seam extension or edge region as well as at the fold-over line there is not applied any such preparation. The wet deposition of the preparation amounts to 2.5 to 3 grams per cut piece. After the application of the preparation the cut pieces are dried for two minutes at 150° C.

After ten boiling washes the stiffness reduction amounted to about 12 percent.

The above-described preparation was applied by means of a screen printing process to one surface of a cut textile piece, the other surface of which was previously provided with a heat-sealable coating. Drying thereof was accomplished at 120° C. for two minutes.

The thus obtained cut textile piece or blank was then bonded with a further fabric layer by pressing or ironing for 15 seconds at 150° C.

EXAMPLE 3

While adhering to the conditions described in Example 2 cut textile pieces were imprinted with a preparation having the following composition:

| | |
|---|---|
| "SOLVITOSE HDF" (strong ether) (20% by weight) | 430 g |
| "STABIFORM 691" (polyvinylacetate) | 140 g |
| "CULMINAL C 1525 K5000" (methyl cellulose thickener) (2% by weight) | 340 g |
| "ANTIMOUSSE H" (silicon defoaming agent) | 20 g |

After 10 boiling washes the reduction in the stiffness amounted to about 10 percent.

EXAMPLE 4

While maintaining the conditions disclosed in Example 2 cut textile pieces were imprinted with a preparation of the following composition:

| | |
|---|---|
| "SOLVITOSE HDF" (strong ether) (20% by weight) | 430 g |
| "PLEXTOL M 600" (acrylic polymer) | 140 g |
| "CULMINAL C 1525 K5000" (methyl cellulose thickener) (2% by weight) | 340 g |
| "ANTIMOUSSE H" (silicon defoaming agent) | .20 g |

After 10 boiling washes the reduction in the stiffness amounted to about 13 percent.

EXAMPLE 5

While maintaining the conditions indicated in Example 2 cut textile pieces were imprinted with a preparation of the following composition:

| | |
|---|---|
| "LUTOFAN 100 D" (vinylchloride dispersion) | 500 g |
| "COLLACRAL V" (polyvinyl pyrrolidone/polyacrylnitrile) (30% by weight) | 500 g. |

After 5 boiling washes the reduction in the stiffness amounted to 23 percent.

EXAMPLE 6

A printing paste was applied according to the process of Example 2 in a pattern at a stamped collar while recessing or reliefing the fold-over portion and seam edge region. The following preparation was used:

| | Desired Result | | |
|---|---|---|---|
| | Soft | Intermediate | Hard |
| Polyvinylacetate-dispersion (50% solids) | 50 g/kg | 150 g/kg | 250 g/kg |
| Methylcellulose (thickening agent) | 12 g/kg | 11 g/kg | 10 g/kg |
| Defoaming Agent | 20 g/kg | 20 g/kg | 20 g/kg. |

The obtained reinforcement effect displayed good resistance to three or more boiling washes.

While there have been described present preferred embodiments of the invention, it is to be distinctly understood that the invention is not limited thereto but may be otherwise variously embodied and practised within the scope of the following claims.

Accordingly, what I claim is:

1. A method of manufacturing a cut textile piece, comprising the steps of:

producing a dimensionally stable web-like flat textile structure;

forming from said flat textile structure cut textile pieces;

applying to at least one such cut textile piece a preparation in a predetermined pattern and in a predetermined quantity;

said preparation containing at least one substance capable of forming a film at least during the employed processing temperature, said film possessing a Shore hardness A of at least 50 at a temperature of about 20° C. and at a temperature of about 100° C. exhibiting a Shore hardness A which at most amounts to 80% of the hardness value measured at 20° C., wherein said film does not melt below about 180° C.; and then drying the thus processed cut textile piece, to thus obtain a wash-resistant variable stiffness over the surface of such cut textile piece.

2. The method as defined in claim 1, wherein:

said Shore hardness A is in the order of 80 to 100 at a temperature of about 20° C.

3. The method as defined in claim 1, including the steps of:

utilizing as the starting material a flat textile structure containing cellulose fibers; and treating the flat textile structure, prior to application of the preparation, at least partially with an agent which selectively reduces any one of the wetability, the swellability, or both, of the cellulose fibers.

4. The method as defined in claim 1, including the step of:

applying the preparation at one face of the cut textile piece.

5. The method as defined in claim 4, further including the step of:

applying to the other face of the cut textile piece which is free of the preparation a heat-sealable coating.

6. The method as defined in claim 5, wherein:

said heat-sealable coating is applied prior to application of the preparation.

7. The method as defined in claim 5, wherein:

said heat-sealable coating is applied after application of the preparation.

8. The method as defined in claim 1, further including the step of:

applying the preparation in stages.

9. The method as defined in claim 1, further including the steps of:

utilizing a preparation containing components, at least one of which is cross-linkable; and cross-linking said cross-linkable component.

10. The method as defined in claim 1, further including the step of:

employing as the substance which forms said film one wherein the film possesses a hardness value at about 100° C. which at most amounts to 75% of the hardness value measured at about 20° C.

11. The method as defined in claim 1, further including the step of:

using as the substance which forms said film one which does not melt below about 200° C.

12. The method as defined in claim 1, further including the step of:

applying the preparation to the cut textile piece by means of a screen printing process.

13. The method as defined in claim 1, including the step of:

applying the preparation to the cut textile piece by spraying.

14. The method as defined in claim 1, including the step of:

employing as the processing temperature a temperature exceeding about 100° C.

15. The method as defined in claim 14, wherein:

such employed processing temperature is in a range of about 120° C. to 200° C.

16. The product produced according to the method of claim 1.

17. The product as defined in claim 16, wherein such product is a substantially flat textile piece.

18. The product as defined in claim 16, used as an insert for garments.

19. The product as defined in claim 18, wherein said insert is a collar insert.

20. The product as defined in claim 18, therein said insert is a cuff insert.

21. A method of manufacturing a blank from a textile structure, comprising the steps of:

forming a blank from said textile structure;

applying to said blank a preparation;

said preparation containing at least one substance capable of forming a film at least during the employed processing temperature, said film possessing a Shore hardness A of at least 50 at a temperature of about 20° C. and at a temperature of about 100° C. exhibiting a Shore hardness A which at most amounts to 80% of the hardness value measured at 20° C., wherein said film does not melt below about 180° C.; and then drying the thus processed blank, to produce a wash-resistant variable stiffness over the surface of said blank.

* * * * *